United States Patent [19]

Kleinert et al.

[11] 4,436,215

[45] Mar. 13, 1984

[54] STORAGE DRAWER WITH RETAINED PARTITIONS

[76] Inventors: Karl W. Kleinert, 19601 Beach Cliff Blvd., Rocky River, Ohio 44116; Kenneth B. Kleinert, 1285 E. Melrose Dr., Westlake, Ohio 44145

[21] Appl. No.: 341,464

[22] Filed: Jan. 21, 1982

[51] Int. Cl.[3] ..... B65D 1/24; B65D 25/04

[52] U.S. Cl. ..... 220/22.3; 220/22; 220/22.2; 312/111; 312/263

[58] Field of Search ..... 312/111, 8, 9, 12, 263; 220/22, 22.3, 22.2

[56] References Cited

U.S. PATENT DOCUMENTS

| | | | |
|---|---|---|---|
| 943,719 | 12/1909 | Vick | 220/22 |
| 1,523,136 | 1/1925 | O'Connor | 220/22.3 |
| 2,020,373 | 11/1935 | Petbold, Jr. | 220/22.3 |
| 2,221,024 | 11/1940 | Hood | 220/22.3 |
| 2,586,925 | 2/1952 | Drengberg | 220/22.3 |
| 2,985,333 | 5/1961 | Kirkman | 220/22.3 |
| 3,200,983 | 8/1965 | Walter | 220/22 |
| 3,656,650 | 4/1972 | Frater | 220/22.3 |
| 4,261,464 | 4/1981 | Maitland | 220/22.3 |
| 4,285,429 | 8/1981 | MacTavish | 312/9 |
| 4,346,813 | 8/1982 | Cho et al. | 220/22 |

*Primary Examiner*—Victor N. Sakran

*Attorney, Agent, or Firm*—Pearne, Gordon, Sessions, McCoy, Granger & Tilberry

[57] ABSTRACT

A storage drawer is disclosed made of a rugged plastic material rather than metal and in which the removable partitions in the drawer are held in place by a wedging action provided by tapering slots on each side. The partitions will not fall out when the drawer is upside-down to remove the contents, but the partition may be easily removed by pulling it out without the necessity of overcoming latching or locking mechanisms.

7 Claims, 7 Drawing Figures

STORAGE DRAWER WITH RETAINED PARTITIONS

BACKGROUND OF INVENTION

1. Field of the Invention

This invention relates to storage drawers such as those used in storage cabinets to hold miscellaneous hardware, fasteners, and other items, and in particular to drawers having lateral removable partitions therein so that the drawer may be used to store a number of different kinds of items.

2. Description of the Prior Art

Storage cabinets are typically used in maintenance facilities, workshops, hardware stores, and other places in which it is necessary to store a variety of fasteners, hardware, or other small items. Storage cabinets typically have large numbers of drawers, usually made of metal. The interior of each of the drawers may be divided laterally so that each drawer may be used to store a number of different kinds of articles. The storage drawers are usually provided with removable, laterally extending partitions for this purpose with means for holding the partitions in any one of a number of positions depending upon the manner in which the drawer is to be divided.

A common problem with the typical metal storage drawers is that the partitions are often loosely held within the drawer and can easily fall out if the drawer is turned upside-down to remove its contents. In addition, the metal storage drawers are subject to chipping paint and rust.

SUMMARY OF THE INVENTION

The present invention provides an improved storage drawer for a storage cabinet which overcomes many of the shortcomings of the prior art storage drawers. The storage drawer of the present invention is made of plastic and thereby overcomes the problems of chipping paint and rust which were common with metal storage drawers. In addition, the storage drawer of the present invention has laterally extending partitions which are held in place in the drawer so that the partitions will not easily fall out when the drawer is turned upside down. The partitions are held in the drawer by a wedging action provided by tapering slots on each side of the drawer interior. As the partition is inserted into the slots, the tapering design of the slots serves to hold the partition securely in place. In addition, tabs are provided on each side of the partition to position the partition in the widened portion at the top of the slot. The tabs also provide a wedging action which enhances the security of the partition within the drawer.

These and other advantages are provided by the storage drawer of the present invention which comprises a bottom, two ends extending from the bottom, and two sides extending from the bottom between the two ends. Each side has a plurality of longitudinally spaced slots extending from the bottom. Each slot is defined by two edges. The edges converge as the slot extends toward the bottom, so that each slot becomes narrower as it extends toward the bottom. Each edge of each slot as a recess extending from the top of the slot. A partition is adapted to be held on each side by one of the slots on the side of the drawer. The partition has protruding tabs which extend from each end on each side of the partition. Each tab is narrower toward the bottom, and each tab extends outwardly further toward the top than at the bottom. Each tab is adapted to fit in one of the recesses. The sides of the partition are adapted to be held by the narrowing slot as the partition is inserted downwardly in the drawer and the tabs are adapted to be held in the recesses. The partition is thus securely held in the drawer and will not readily fall out when the drawer is turned upside-down. However, the partition can be easily removed from the drawer by simply pulling upward and no latch mechanism or lateral movement of the partition is needed to release the partition from the drawer.

DETAILED DESCRIPTION OF THE PREFERRED EMBODIMENT

Figure 1:
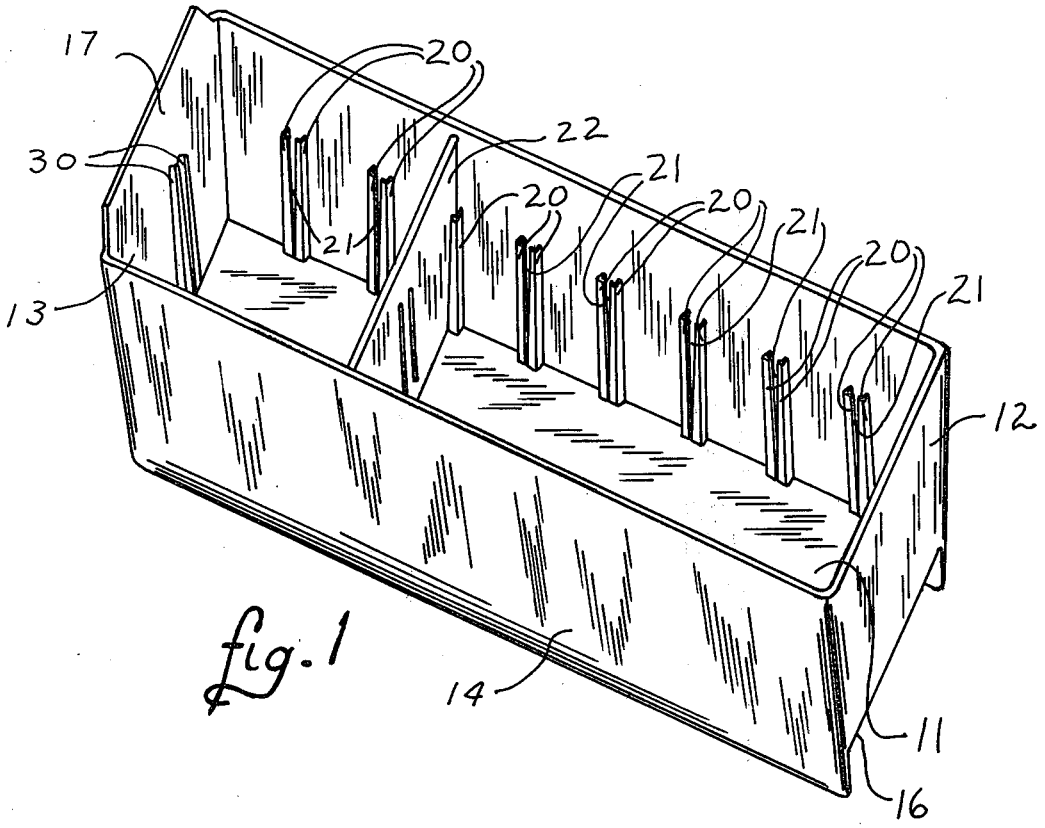
FIG. 1 is a perspective view of the storage drawer of the present invention.

Referring more particularly to the drawings, and initially to FIG. 1, there is shown a storage drawer 10 according to the present invention. The drawer 10 provides a storage compartment formed by a flat rectangular bottom 11, a pair of ends 12 and 13, and a pair of elongated sides 14 and 15. The front end 12 may be provided with a recess 16 to provide a hand-hold so that the drawer may be pulled out from the cabinet in which it is used. The back end 13 has a raised portion 17 which extends above the height of the sides 14 and 15 and which provides a stop to prevent the drawer from being pulled completely out of the cabinet inadvertently.

The ends 12 and 13 are not exactly rectangular but have a slight trapezoidal shape so that the sides 14 and 15 are not precisely parallel to each other. The top of the sides 14 and 15 are further apart than the bottom of the sides to provide a slight trough shape to the drawer 10.

Each side 14 and 15 is provided with a plurality of pairs of ridges 20 along the inside of the drawer. The pairs of ridges are laterally spaced along the inside of each side of the drawer and are identically spaced on each side 14 and 15. Each pair of ridges 20 provides a slot 21 therebetween for holding one end of a partition 22 which extends laterally across the inside of the drawer. Although only one partition 22 is shown in FIG. 1, it is to be understood that as many partitions may be inserted in the drawer as there are slots to hold the partitions.

Figure 2:
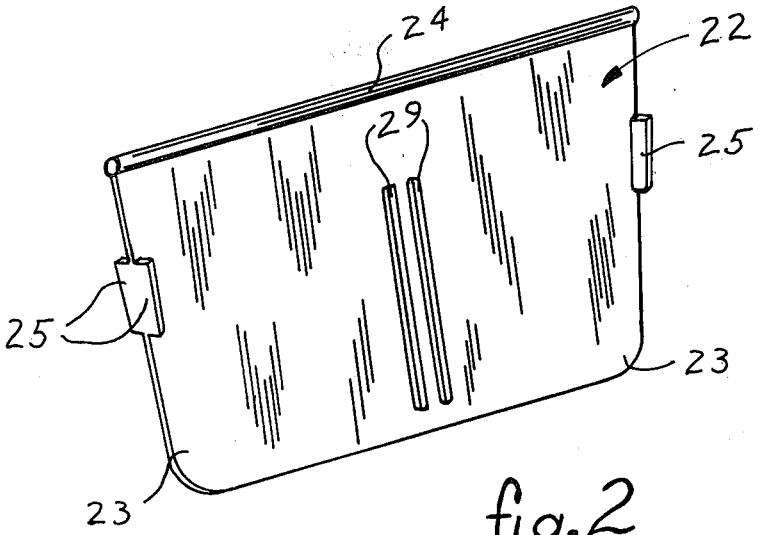
FIG. 2 is a perspective view of the partition used in the storage drawer of FIG. 1.
Figure 3:
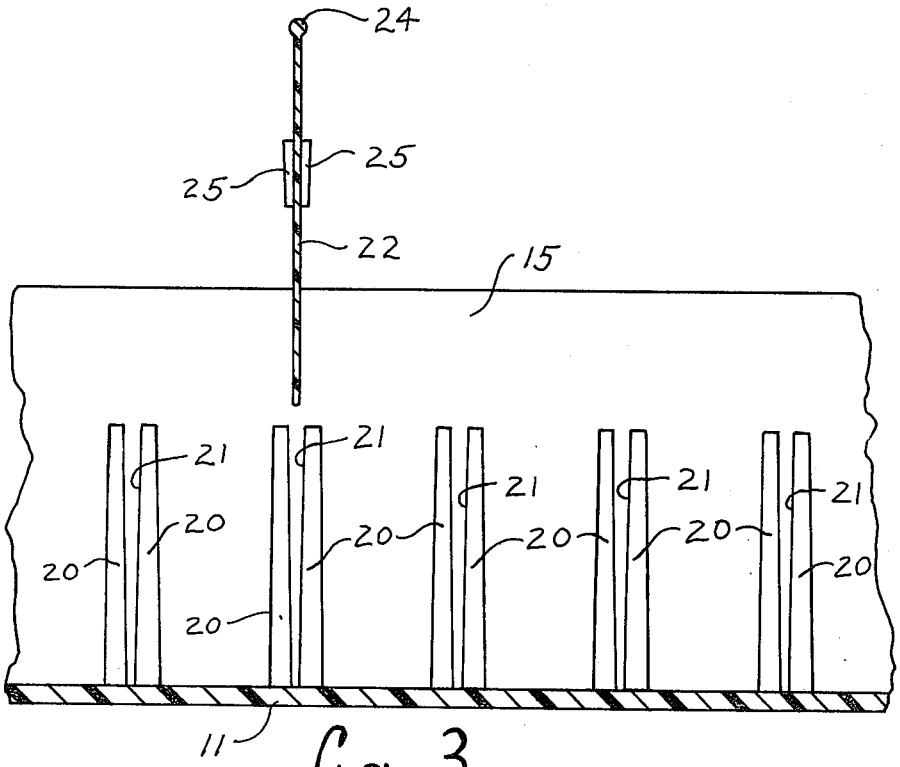
FIG. 3 is a sectional view taken along the side of the storage drawer of FIG. 1, showing the partition as it is inserted into one of the slots.

The partition 22 is shown in greater detail in FIG. 2. The partition 22 is generally trapezoidal in shape to conform to the trapezoidal cross section of the drawer 10, and has rounded bottom corners 23 which are hidden by the ridges 20 when the partition is in the drawer. Due to the trapezoidal shape of the drawer cross section, the partition 22 is essentially wedged into place as it is inserted into the drawer. The partition 22 has an enlarged top edge 24 extending across the top of the partition to assist in removing the partition from the drawer. The partition 22 is held at one end in one of the slots 21 formed by a pair of ridges 20 and is securely held thereby because of the tapering shape of the slot 21. With reference to FIG. 3, it can be seen that each slot 21 is wider at the top of the ridges 20 and is substantially narrower at the bottom of the ridges. The width of the slot 21 at the bottom is approximately equal to or slightly less than the thickness of the partition 22. Thus, as each partition 22 is inserted into the drawer and the ends of the partition are inserted into one of the slots 21 between a pair or ridges 20, the partition 22 is wedged into position and the bottom of the partition is securely held within the slot 21.

At each end of the partition 22, a pair of tabs 25 are provided. Each tab 25 extends from each side of the partition 22 at both ends thereof. The tabs 25 extend outwardly and are generally trapezoidal in shape when viewed from the ends of the partition 22. In addition, each tab is tapered in cross section so that it is wider at the top than at the bottom.

Figure 5:
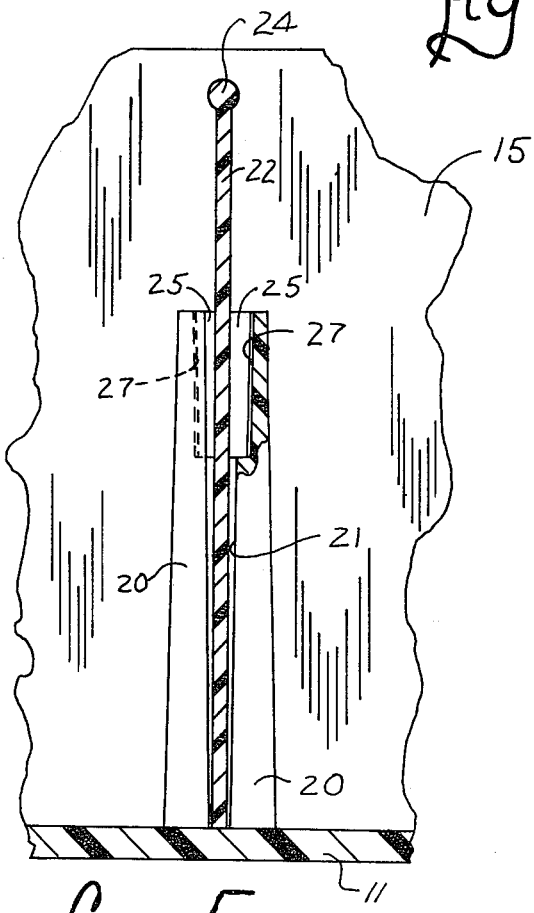
FIG. 5 is a sectional view of a portion of FIG. 3 to a larger scale, showing the partition fully inserted into the slot.
Figure 6:
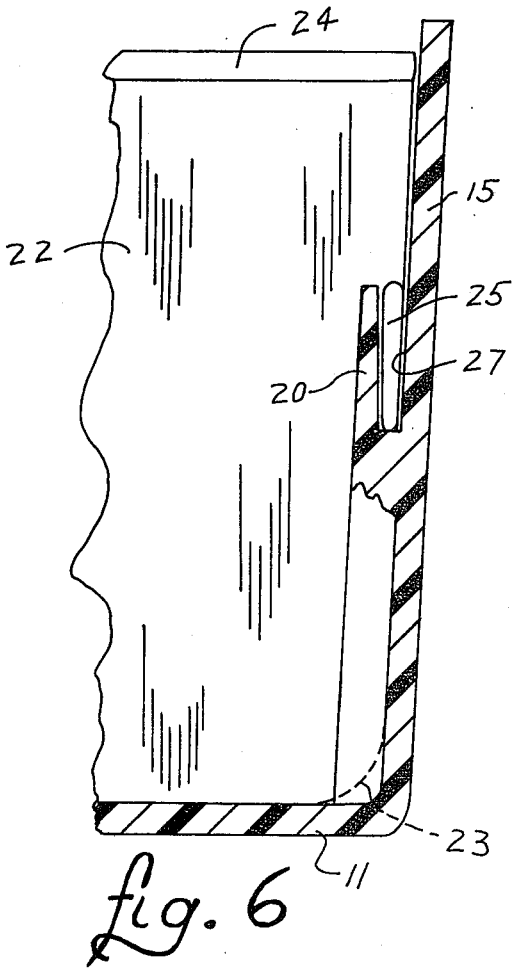
FIG. 6 is a sectional view of a portion of FIG. 4, showing the partition fully inserted into the slot, as taken along line 6—6 of FIG. 5.
Figure 4:
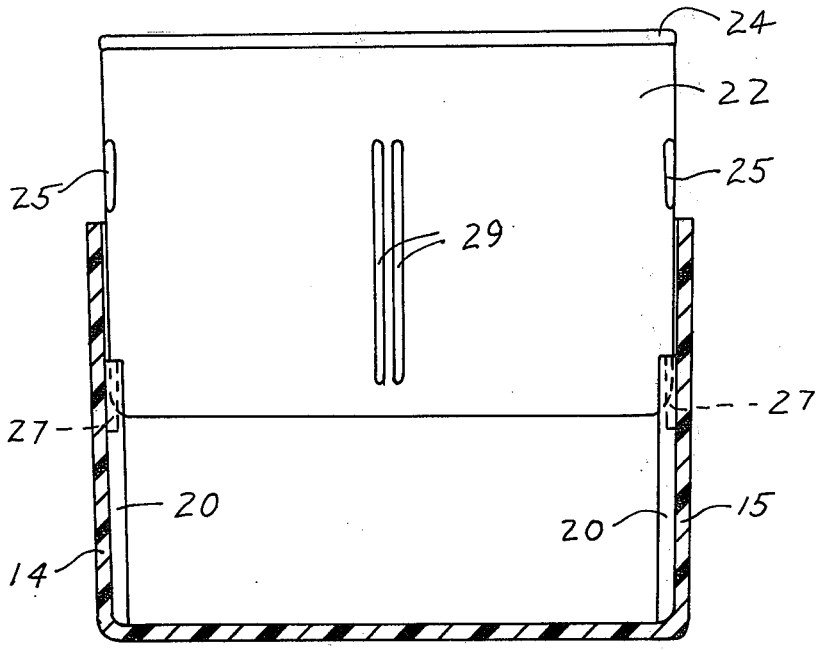
FIG. 4 is a sectional view taken along the end of the storage drawer of FIG. 1, showing the partition as it is inserted into the slots.
Figure 7:
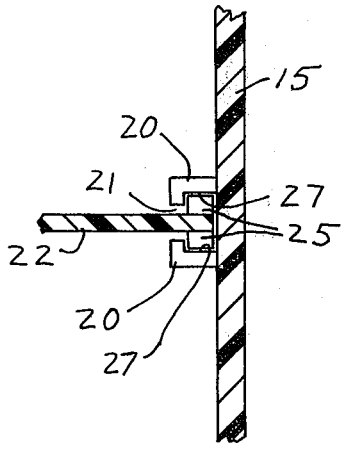
FIG. 7 is a top sectional view of the end of the partition inserted into the slot.

Each tab 25 on the partition 22 is adapted to be received in a correspondingly shaped recess 27 provided on each of the ridges 20 on the sides 14 and 15 of the drawer. The recesses 27 can be seen in greater detail in FIGS. 5–7. Each recess 27 extends into each ridge 20 from the slot 21 formed by the pair of ridges 20, so that the top of each ridge 20 has an L-shaped cross section (FIG. 7). Each recess 27 extends from the top of each ridge toward the bottom to a point approximately equal to the height of the bottom of the tabs 25.

As each partiton is inserted into the drawer, the tabs 25 on each end of the partition are inserted into the tops of the recesses 26 on each of the pair of ridges 20. The tabs 25 hold the partition securely in place at the top of the slot 21. The top of the slot 21 is wider, and without the tabs 25, the partition would tend to be subject to lateral movement and would appear to be very loose. The tabs 25 prevent the lateral movement and assure that the partition 22 will be securely positioned within the slot 21. In addition, each of the tabs 25 is tapered and extends outwardly further from the sides of the partition at the top than at the bottom, so that each tab 25 also provides a wedging action within the recess 27 to hold the partition in place more securely. Furthermore, with reference to FIG. 6, each tab 25 is also tapered in thickness, with the top of the tab being thicker than the bottom of the tab. Each recess 27 is dimensioned so that the tab 25 also wedges into the recess in this dimension to increase the hold on the partition.

The partition 22 may also be provided with a pair of ribs 29 extending in a direction from top to bottom along the middle of both sides. The ribs 29 match similar ribs 30 provided on the inside of the back end 13. In addition, similar ribs may also be provided on the interior of the front end 12. The ribs 30 are provided for positioning and holding longitudinally extending dividers which may also be provided with the storage drawer 10.

The entire drawer 10, including the partition 22, is formed of a rugged plastic material, such as polyethylene, polypropylene, polyvinyl chloride, nylon, or other suitable material. Such material is not susceptible to scratching, chipping, dents, and rust, as is conventional painted metal, and its assists in the wedging engagement of the partition in the drawer, since the plastic material has a greater compressive elasticity than the metal.

The overall effect of the storage drawer 10 of the present invention is that each partition 22 is held in place in the drawer by a number of different wedging actions. Each slot 21 is tapered to provide wedging action as the end of the partition 22 is inserted into the slot; each tab 25 on the partition is trapezoidal or tapered to provide a wedging action within the recess 27; each tab 25 is also tapered in thickness to provide an additional wedging action within the recess 27; and finally, the inside cross section of the drawer is generally trapezoidal so that each partition 22 is wider at the top than at the bottom, so that the partition is wedged in place as it is inserted down in the drawer. These wedging actions assure that each partition will be securely held in place in the drawer and will not fall loose when the drawer is turned upside-down to empty the contents of the drawer. However, since no latching or locking mechanism is provided with the holding of the partition, each partition may be easily removed from the drawer without overcoming a latching or locking mechanism, and the partition may be easily moved within the drawer to accommodate the desired division of the drawer compartment.

While the invention has been shown and described with respect to specific embodiments thereof, it will be apparent to those skilled in the art that other variations and modifications of the specific form herein shown and described may be used without departing from the spirit and scope of the invention. Accordingly, the patent is not to be limited in scope and effect to the specific embodiments herein shown and described, nor in any other way which is inconsistent with the extent to which the progress in the art has been advanced by this invention.

What is claimed is:

1. A storage drawer which comprises:

a bottom;

two ends extending from the bottom;

two sides extending from the bottom between the two ends, each side having a plurality of longitudinally spaced slots extending from the bottom, each slot defined by two edges, the edges being formed by a pair of ridges which extend from the side, the edges converging as the slot extends toward the bottom so that each slot becomes narrower as its extends toward the bottom, each ridge having a recess extending into the ridge from the edge of the slot and extending from the top of the slot toward the bottom thereof, the recesses for each pair of ridges being opposite each other, each recess extending into the ridge in a direction generally perpendicular to the slot; and a partition adapted to be held on each side by one of the slots on the side of the drawer, the partition having a pair of diametrically opposed protruding tabs which extend from each end on each side of the partition, each tab adapted to fit in one of the recesses, the sides of the partition adapted to be held by the narrowing slot as the partition is inserted into the drawer, and the tab adapted to be held in the recesses.

2. A storage drawer as defined in claim 1, wherein each of the tabs protrudes farther from the partition at the top of the tab than at the bottom of the tab so that the tabs are wedged into the recess as the partition is inserted into the drawer.

3. A storage drawer as defined in claim 1, wherein each of the tabs is thicker at the top than at the bottom so that the tab is wedged into the recess as the partition is inserted into the drawer.

4. A storage drawer as defined in claim 1, wherein the partition and at least one of the ends are provided with a pair of ribs extending in a direction generally from top to bottom and adapted to receive a longitudinally extending divider which is generally transverse to the partition.

5. A storage drawer as defined in claim 1, wherein each of the ends is generally trapezoidal in shape so that the two sides are further apart at the top of the drawer than at the bottom, and the partition is generally trapezoidal in shape and has essentially the same shape as the cross section of the drawer.

6. A storage drawer as defined in claim 1, wherein the drawer is formed entirely of plastic.

7. A storage drawer which comprises:

a bottom;

two ends extending from the bottom, each of the ends generally trapezoidal in shape;

two sides extending from the bottom between the two ends, each of the sides closer together at the top than at the bottom, each side having a plurality of longitudinally spaced slots extending from the bottom, each slot defined by two edges, the edges being formed by a pair of ridges which extend from the side, the edges converging as the slot extends toward the bottom so that each slot becomes narrower as it extends toward the bottom, each ridge having a recess extending into the ridge from the edge of the slot and extending from the top of the slot toward the bottom thereof, the recesses for each pair of ridges being opposite each other, each recess extending into the ridge in a direction generally perpendicular to the slot;

a partition which is generally trapezoidal in shape and is essentially the same shape as the cross section of the drawer, the partition adapted to be held on each side by one of the slots on the side of the drawer, the partition having a pair of diametrically opposed protruding tabs which extend from each end on each side of the partition, each tab being narrower toward the bottom and each tab extending outwardly further from the partition toward the top than the bottom, each tab adapted to fit into one of the recesses, the sides of the partition adapted to be held by the narrowing slot as the partition is inserted downwardly into the drawer and the tabs adapted to be wedged into the recesses and held thereby.

* * * * *

UNITED STATES PATENT AND TRADEMARK OFFICE

CERTIFICATE OF CORRECTION

PATENT NO. : 4,436,215

DATED : March 13, 1984

INVENTOR(S) : Karl W. Kleinert and Kenneth B. Kleinert

It is certified that error appears in the above—identified patent and that said Letters Patent is hereby corrected as shown below:

Column 1, line 62, change "as" to --has--.

Column 3, line 39, change "26" to --27--.

Column 4, line 49, change "its" to --it--.

Signed and Sealed this

Tenth Day of July 1984

[SEAL]

*Attest:*

GERALD J. MOSSINGHOFF

*Attesting Officer*

*Commissioner of Patents and Trademarks*